US005695016A

United States Patent [19]

Deeter et al.

[11] Patent Number: 5,695,016

[45] Date of Patent: Dec. 9, 1997

[54] AUGER TELESCOPING HOIST ASSEMBLY AND HOLDING FORK MECHANISM

[75] Inventors: Ronald C. Deeter, Coshocton; Randal L. Keefer, Salem, both of Ohio

[73] Assignee: Brydet Development Corp., Coshocton, Ohio

[21] Appl. No.: 533,790

[22] Filed: Sep. 26, 1995

[51] Int. Cl.[6] ..... E21C 5/00

[52] U.S. Cl. ..... 175/85; 173/2.8

[58] Field of Search ..... 175/57, 85; 173/28, 173/164, 189; 299/55, 87.1

[56] References Cited

U.S. PATENT DOCUMENTS

| | | | |
|---|---|---|---|
| 2,935,309 | 3/1960 | McCarthy . | |
| 3,091,439 | 5/1963 | Adams et al. . | |
| 3,236,315 | 2/1966 | Lora . | |
| 3,278,236 | 10/1966 | Adams et al. . | |
| 3,281,187 | 10/1966 | Adams et al. . | |
| 3,663,062 | 5/1972 | Young et al. . | |
| 3,746,110 | 7/1973 | Young et al. . | |
| 3,754,604 | 8/1973 | Inaba et al. | 173/28 |
| 3,918,536 | 11/1975 | Deeter et al. . | |
| 3,972,375 | 8/1976 | Deeter et al. . | |
| 4,059,163 | 11/1977 | Stedman . | |
| 4,264,106 | 4/1981 | Deeter et al. . | |
| 4,732,224 | 3/1988 | Deeter et al. . | |
| 4,877,091 | 10/1989 | Howell, Jr. | 173/89 |
| 4,938,296 | 7/1990 | Brazell, II | 173/22 |
| 5,236,054 | 8/1993 | Jack et al. | 175/57 |
| 5,479,728 | 1/1996 | Deken et al. | 37/142.5 |

*Primary Examiner*—Frank Tsay
*Attorney, Agent, or Firm*—Frederic E. Naragon

[57] ABSTRACT

A telescoping hoist assembly and holding fork mechanism for an augering apparatus comprising a telescoping hoist arm with independently operating lift capability to lift auger flights to add them to or remove them from a string driving a cutting head for augering operations and a fork ram mechanism moveable horizontally and vertically within the augering apparatus to assist in the positioning of auger flights in their addition to or removal from the string.

5 Claims, 6 Drawing Sheets

AUGER TELESCOPING HOIST ASSEMBLY AND HOLDING FORK MECHANISM

BACKGROUND OF THE INVENTION AND SUMMARY OF THE INVENTION

The present invention relates generally to a telescoping hoist assembly and holding fork mechanism primarily as an improvement to an auger apparatus of the type that bores deep, laterally extending holes into minable material in the earth by an auger formed by a string of connected, helically vaned sections known in the industry as flights, and more particularly to an auger apparatus for the mining of coal and other minable materials.

The invention provides exceptional advantages when employed in auger mining machines of the type adapted to be positioned adjacent an upwardly extending wall to recover material to be mined from a seam of minable material such as coal that is exposed in such wall and extends generally laterally into the earth. Therefore, for convenience, the invention will be discussed in connection with such a machine for mining coal, although it may be applicable to other types of auger apparatus.

Auger mining machines of this type comprise an auger embodying a cutting head of selected diameter suitable to the thickness of the coal seam connected to and rotatably driven by a string of endconnected, helically vaned auger sections known in the industry as flights, driven from the machine by being rotated and urged longitudinally of the auger. The cutting head penetrates the coal seam, and the mined coal is transported rearwardly from the cutting head along the auger string by the vanes of the auger flights out of the hole cut by the cutting head to a conveyor on the machine by which the coal is removed.

As the cutting head is caused to penetrate into the hole, it is necessary to introduce auger flights into the string until the desired length of the auger string is reached to achieve the desired depth of the hole. After the cutting head has penetrated to the desired depth of hole, it must be withdrawn by removing auger flights until the cutting head is out of the hole. The machine as a whole may then be moved laterally to another position where its auger can drill another hole generally parallel to the previously drilled hole.

In order to achieve the desired high production, it is necessary rapidly and accurately to handle the auger flights in taking them from a store of flights and placing them in the auger string as the hole is bored, and then in removing the auger flights from the auger string as the auger is withdrawn from the hole. The auger flights are quite heavy, often weighing several thousand pounds or more, particularly those of large diameter. It is desirable that the flights be rapidly lifted and put in place accurately longitudinally and rotationally in the auger string to enable them to be connected preferably automatically to the driving means on the auger machine and to other auger flights in the string when the auger flights are being placed in the string; and to be lifted from and removed from the auger string when necessary after the auger flights are disconnected, preferably by remote control from the driving means and from other auger flights.

Because of the size and weight of the auger flights, they must be handled by mechanical hoist means. The hoist means should be such that it can carry out the above functions rapidly and without danger to the operator. It is important that the operator closely observe the position of the auger flight or flights being handled by the hoist means when he is controlling the hoist means to handle the auger flights rapidly and accurately, but that in doing so the operator remain in a safe place free of any danger of being struck by an auger flight being moved by the hoist means.

Typically, and heretofore, the mechanical hoist means has comprised a crane of fixed boom length, and the auger flights have been typically stored along side the augering machine to be picked up and returned by the hoist means and placed onto or taken out of the string. The number of flights which can be stored along side the machine and picked up by the hoist means is limited because of the fixed length of the beam of the mechanical hoist means. In addition, and heretofore, when drilling coal seams that pitch on varying angles, the drop point of the auger flight in the frame changes and with a fixed beam of a mechanical hoist means, it is difficult to match the auger flights in attaching or detaching them to the string at the change points.

The present invention provides an improved telescoping hoist assembly which provides a greater reach than a fixed beam pick up type hoist means thus providing the ability to stack greater quantities of auger flights alongside the machine and to pick up and attach or detach a greater number of auger flights to the string. The present invention also provides greater flexibility, both in stacking and picking up auger flights since the hook of the assembly can be positioned directly over the pick up point of the auger flights. Also, the present invention provides an improvement when drilling coal seams that pitch on varying angles where the drop point of the auger flights in the frame changes because the telescoping feature and hook positioning feature of the present invention provides the flexibility to match the auger flights at these changing points. Further, the present invention provides an improvement due to the direct attachment of the lift cylinder arm to the top of the telescoping arm of the telescoping hoist which permits the lift and telescope functions to operate independently. Heretofore, on conventional designs of telescoping hoists, the lifting mechanism does not move with the telescoping arm and retracting the arm causes the load to lower and extending the arm causes the load to lift. To overcome this the operator has to operate the lift and telescope function simultaneously which is not practicable to do on a coal recovery auger where the hoist speed is critical for efficient operation of the machine.

The holding fork mechanism of the present invention is an additional improvement and serves as a stop to secure the auger flights in the augering machine when the auger flights are being unloaded and disconnected from other auger flights in the string.

Heretofore unloading auger flights to an augering machine, and particularly when the augering is being done on an incline, misalignment would occur with the disconnecting of auger flights and cause the auger flights to move into the augered hole making the retrieval difficult and time consuming.

In the present invention a telescopic hoist assembly is provided which is used to move the auger flights into place from a stack or rack. The hoist in accordance with the present invention uses a horizontally extendable telescoping arm that extends the reach of the arm. This telescoping arm rides above the main hoist structure using only two rollers. These rollers run in slots located at the neutral axis of the telescoping arm. In the present invention the lift cylinders and the guide rails for a traveling sheave for the lift cable can be attached directly to the top of the telescoping arm. The lifting mechanism being attached directly to the top of the telescoping arm allows the lift and the telescoping functions to occur independently.

The improvement of an auger holding fork mechanism of the present invention provides a downwardly directed fork assembly, generally at the front end of the rails along which the propulsion unit can move. The fork mechanism serves as a stop to secure the auger flights in the machine when a new auger flight is being disconnected from the end of the previously advanced auger string. The holding fork mechanism is of particular importance when the augering is being done on an incline and the mechanism is used to prevent the auger flights at the time of removal from slipping or sliding back into the augered hole. This is especially critical when the propulsion unit of the machine moves forwardly on its carriage to engage the next auger flight to be retrieved. If the auger flight is not held in position, then misalignment occurs and the string of auger flights tends to slide away from the drive chuck of the propulsion unit. The fork mechanism insures alignment and non-slippage of the auger flight string. A fork ram hydraulic cylinder is secured above the center of guide rails and allows the fork ram to be inclined or tilted rearwardly with respect to a vertical plane which greatly improves the ability to secure the auger flights in the augering machine when auger flights are being unloaded or disconnected from other auger flights.

Generally in operation of the present invention the auger machine comprises a propulsion unit mounted on spaced rails and used to advance a coal auger which is made up of a plurality of auger flights into a coal seam. The auger rotates about a generally horizontal axis of rotation. The propulsion unit moves forwardly with the auger as it advances the auger into a coal seam. Once the outer most auger flight has been fully advanced, it is disconnected from the propulsion device which is moved back along the rails and a succeeding auger flight is set in place with its forward end being connected to the outer end of the prior auger flight and with its trailing end being connected to the propulsion unit. This process is repeated until the desired depth of the hole is achieved by connecting additional auger flights in the same manner as above indicated. The telescoping hoist assembly and holding fork mechanism provide an improvement in the loading and unloading and securing or detaching of the auger flights in the machine.

The prior art discloses patents for augering machines and other improvements to augering apparatus and some of the patents are listed as follows:

| | |
|---|---|
| U.S. Pat. No. 2,935,309 - Vincent J. McCarthy | May 3, 1960 |
| U.S. Pat. No. 3,091,439 - G. L. Adams, et al. | May 28, 1963 |
| U.S. Pat. No. 3,236,315 - T. A. Lora | Feb. 22, 1966 |
| U.S. Pat. No. 3,278,236 - G. L. Adams, et al. | Oct. 11, 1966 |
| U.S. Pat. No. 3,281,187 - G. L. Adams, et al. | Oct. 25, 1966 |
| U.S. Pat. No. 3,663,062 - William G. Young et al. | May 16, 1972 |
| U.S. Pat. No. 3,746,110 - William G. Young et al. | July 17, 1973 |
| U.S. Pat. No. 3,918,536 - Ronald C. Deeter et al. | Nov. 11, 1975 |
| U.S. Pat. No. 3,972,375 - Ronald C. Deeter et al. | Aug. 3, 1976 |
| U.S. Pat. No. 4,059,163 - Ronald N. Stedman | Nov. 22, 1977 |
| U.S. Pat. No. 4,264,106 - Ronald C. Deeter et al. | Apr. 28, 1981 |
| U.S. Pat. No. 4,732,224 - Ronald C. Deeter et al. | Mar. 22, 1988 |

U.S. Pat. No. 2,935,309 issued to Vincent J. McCarthy on May 3, 1960, pertains to a skid mechanism for moving auger machines but does not teach of any hoist mechanism or any holding fork mechanism for auger flights as is provided in the present invention.

U.S. Pat. No. 3,091,439 issued to G. L. Adams, et al. on May 28, 1963, pertains to a dual auger and the method of attaching auger storage racks, but does not teach of either a telescoping hoist assembly or holding fork mechanism as provided in the present invention.

U.S. Pat. No. 3,236,315 issued to T. A. Lora on Feb. 22, 1966, discloses an augering apparatus with a Kelly bar type of drive mechanism but does not teach of a telescoping hoist assembly or holding fork mechanism as is provided in the present invention.

U.S. Pat. No. 3,278,236 issued to G. L. Adams, et al. on Oct. 11, 1966, teaches of a means for unlatching auger sections or flights but does not teach of a telescoping hoist assembly or holding fork mechanism as is provided in the present invention.

U.S. Pat. No. 3,281,187 issued to G. L. Adams, et al. on Oct. 25, 1966, provides for a horizontal extendable and retractable telescoping means on the hoist to position the auger flights which provides a hoist with extensible boom and extension motor to extend or retract the boom and extensible or retractable sheave. A lift cylinder is provided which is internal and limits the stroke i.e. lift cable travel, and the telescoping boom slides metal on metal thus limiting its capacity. The present invention provides a lift cylinder which is positioned on top of the telescoping arm providing greater stroke and lift travel and the present invention provides for rollers on hardened ways for greater lifting capacity. In addition, the present invention provides for a holding fork mechanism which is not disclosed in the aforementioned patent.

U.S. Pat. No. 3,663,062 issued to William G. Young, et al. on May 16, 1972, pertains to the drive means for driving one, two or three auger strings with a single power source This patent does not teach of a telescoping hoist assembly or holding fork mechanism as is provided in the present invention.

U.S. Pat. No. 3,746,110 issued to William G. Young, et al. on Jul. 17, 1973, provides for a pendant control means for controlling the hoist functions. The present invention does not employ a pendant control means but is controlled by a single handle remote hydraulic joystick by the same operator that controls the other machine functions. The pendant control of the aforementioned patent requires separate operators for the hoist and other functions of the machine.

U.S. Pat. No. 3,918,536 issued to Ronald C. Deeter, et al. on Nov. 11, 1975, provides for a hoist mechanism with lift, bridge and trolley functions similar to a standard overhead, industrial building crane. This patent does not teach of any telescoping hoist assembly or holding fork mechanism as is provided in the present invention.

U.S. Pat. No. 3,972,375 issued to Ronald C. Deeter, et al. on Aug. 3, 1976, teaches of a drive means for driving single or multiple auger strings. The present invention provides an improvement in a telescoping hoist assembly and holding fork mechanism which is not disclosed in the aforementioned patent.

U.S. Pat. No. 4,059,163 issued to Ronald N. Stedman on Nov. 22, 1977, discloses an auger machine that will cut a square hole, but does not teach of a telescoping hoist assembly or holding fork mechanism as is provided in the present invention.

U.S. Pat. No. 4,264,106 issued to Ronald C. Deeter, et al. on Apr. 28, 1981, discloses a hoist mechanism but does not teach of a telescoping hoist assembly or holding fork mechanism as is provided in the present invention.

U.S. Pat. No. 4,732,224 issued to Ronald C. Deeter, et al. on Mar. 22, 1988, discloses and teaches of a hoist mechanism with special link construction to fit under a roof mechanism but does not teach of a telescoping hoist assembly as is provided in the present invention or a holding fork mechanism as is further provided in the present invention.

ABSTRACT OF THE DRAWINGS

Figure 1:
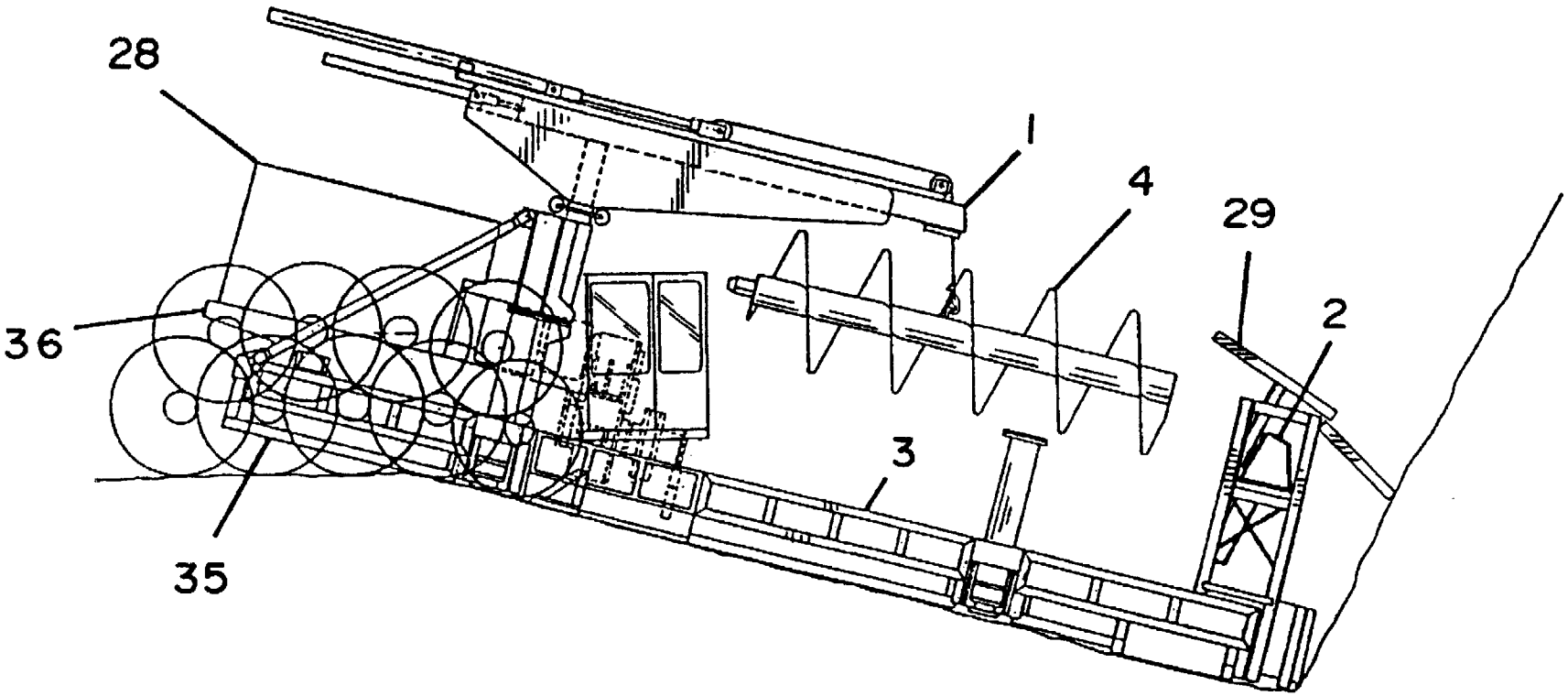
FIG. 1 shows a side elevation of an augering apparatus in an inclined position with the telescoping hoist assembly of the present invention lifting an auger flight into or out of the augering apparatus and further illustrates the holding fork mechanism of the present invention in position on the augering apparatus.

1 is the telescoping hoist assembly;
2 is the holding fork mechanism;
3 is the augering apparatus;
4 is the auger flight;
5 is the mast arm support;
6 is the telescoping mast arm;
7 is the mast arm roller;
8 is the sleeve bearing;
9 is the mast arm roller shaft;
10 is the roller shaft retainer;
11 is the wear plates;
12 is the mast arm guide;
13 is the mast arm hydraulic cylinder;
14 is the mast arm slot;
15 is the hydraulic lift cylinder;
16 is the lift cable sheave;
17 is the guide rail;
18 is the lift cable;
19 is the hose track;
20 is the fork ram;
21 is the fork mounting bracket;
22 is the drive chuck;
23 is the fork guide rail;
24 is the fork guide bracket support;
25 is the fork slide hydraulic cylinder;
26 is the auger flight tab;
27 is the fork hydraulic cylinder;
28 is the propulsion unit;
29 is the front high wall guard;
30 is the mast socket;
31 is the mast pole;
32 is the stationary lift cable sheave;
33 is the auger hoist hook;
34 is the fork ram arms;
35 is the frame;
36 is the carriage.

DETAILED DESCRIPTION OF THE DRAWINGS

Reference is now made to the drawings wherein the present invention is illustrated in detail and wherein similar components bear the same reference numeral throughout the several views.

FIG. 1 shows a side elevation of an augering apparatus 3 in an incline position with the telescoping hoist assembly 1 of the present invention lifting and auger flight 4 out of the augering apparatus 3 and further illustrates the holding fork mechanism 2 of the present invention in position on the augering apparatus 3 and further illustrates the propulsion unit 28, front high wall guard 29, frame 35, and carriage 36.

Figure 2:
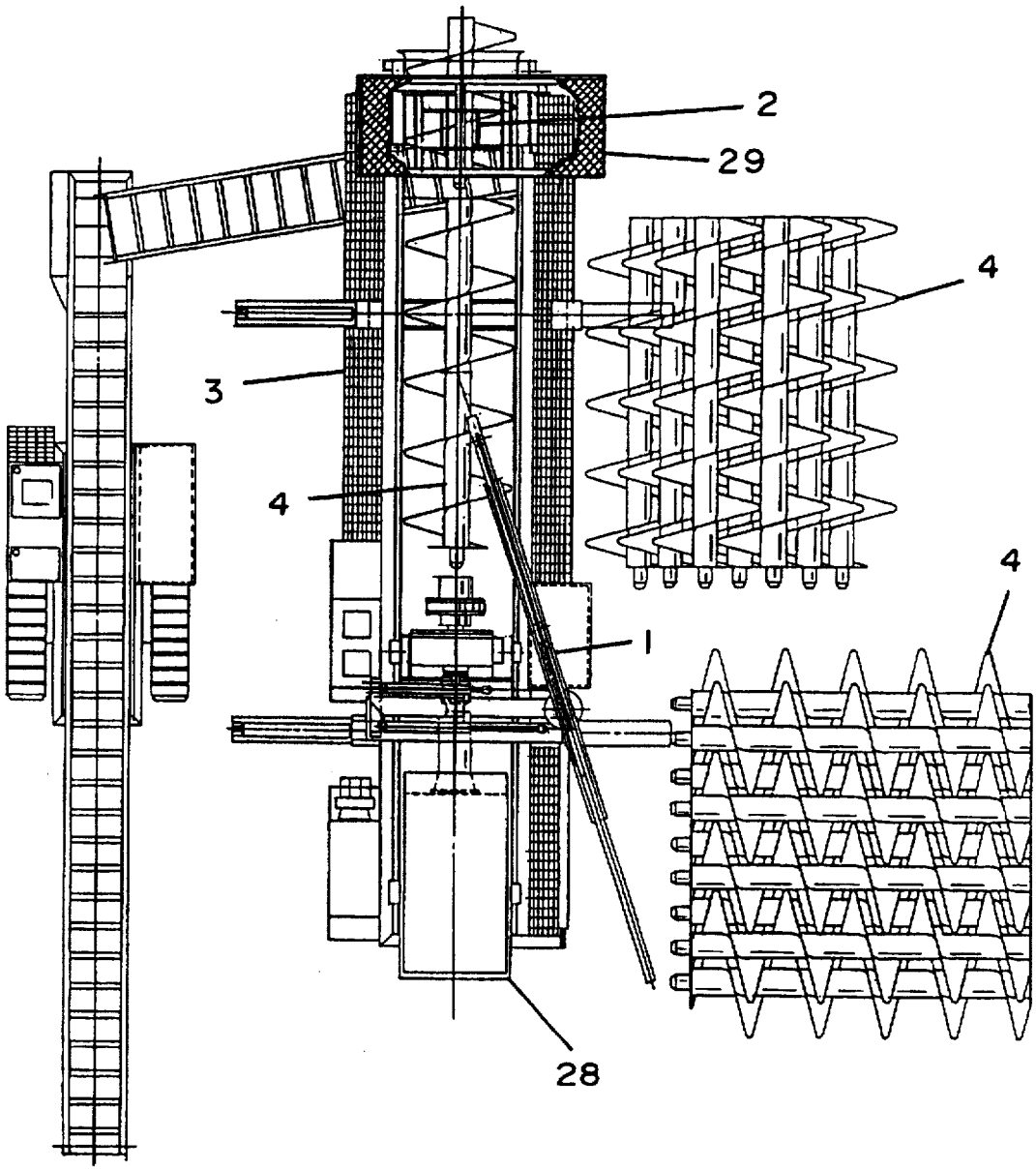
FIG. 2 shows a plan view of FIG. 1 with the telescoping hoist assembly and holding fork mechanism of the present invention in position and illustrates the increased capability of storage of auger flights adjacent to the augering apparatus.

FIG. 2 shows a plan view of FIG. 1 with the telescoping hoist assembly 1 and holding fork mechanism 2 of the present invention in position and illustrates the increased capability of storage of auger flights 4 adjacent to the augering apparatus 3 and further illustrates the propulsion unit 28 and front high wall guard 29.

Figure 3:
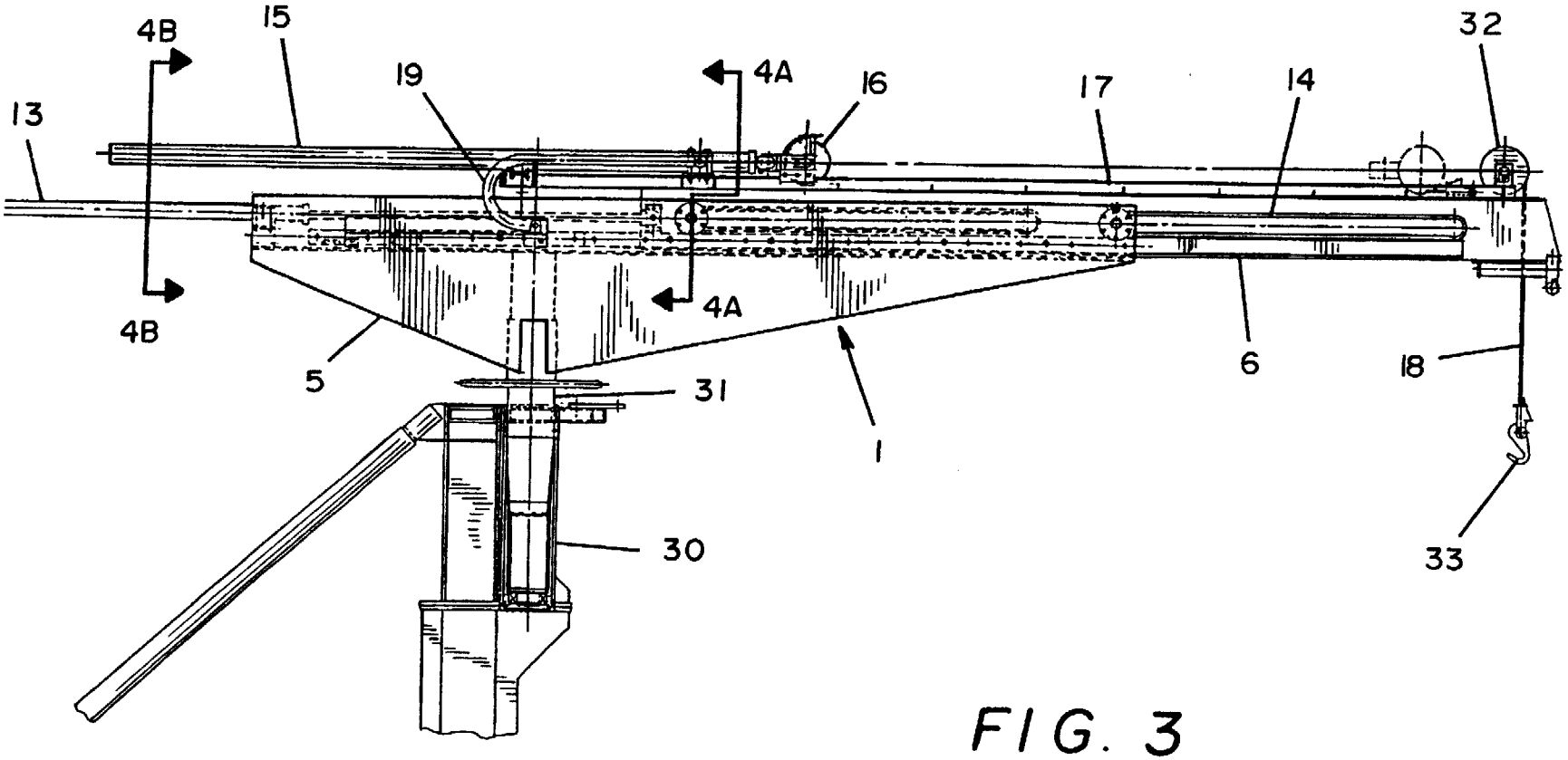
FIG. 3 illustrates a side elevation of the telescoping hoist assembly of the present invention with the telescoping mast arm illustrated in extended position.

FIG. 3 illustrates a side elevation of the telescoping hoist assembly 1 of the present invention with the telescoping mast arm 6 illustrated in extended position and further illustrates mast arm support 5, mast arm hydraulic cylinder 13, mast arm slot 14, hydraulic lift cylinder 15, lift cable sheave 16, guide rail 17, lift cable 18, hose track 19, mast socket 30, mast pole 31, stationary lift cable sheave 32, and auger hoist hook 33.

Figure 4B:
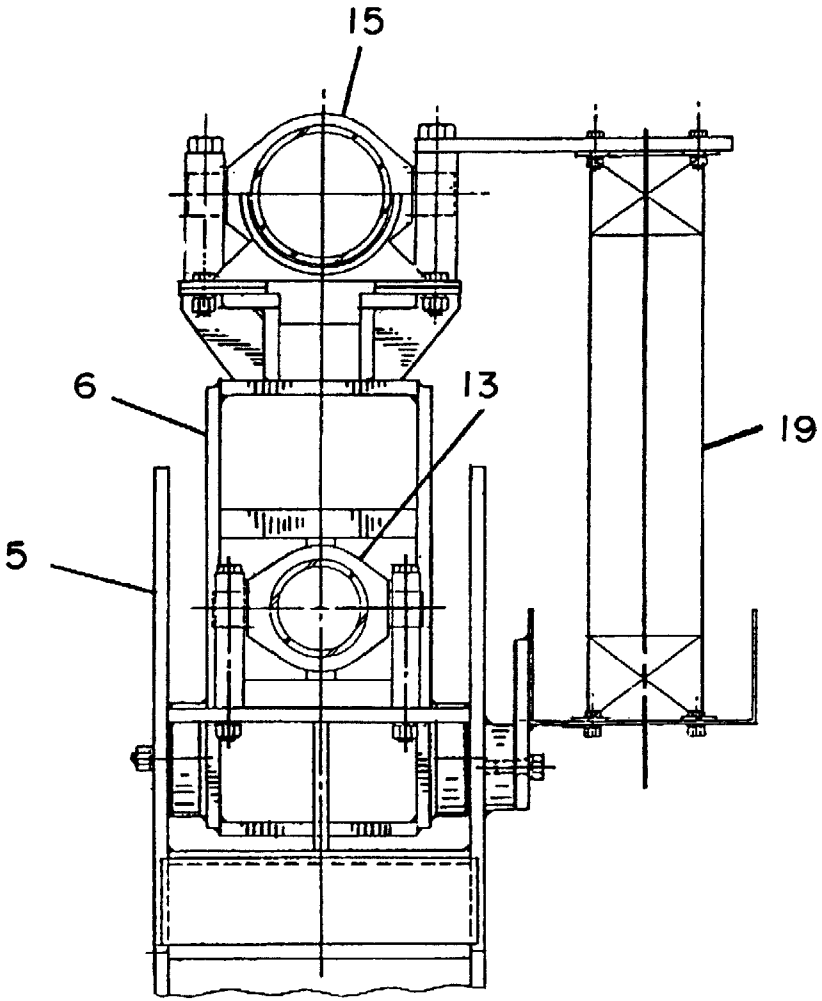
FIG. 4B is an end view of the telescoping hoist assembly of the present invention along line B—B of FIG. 3.
Figure 4A:
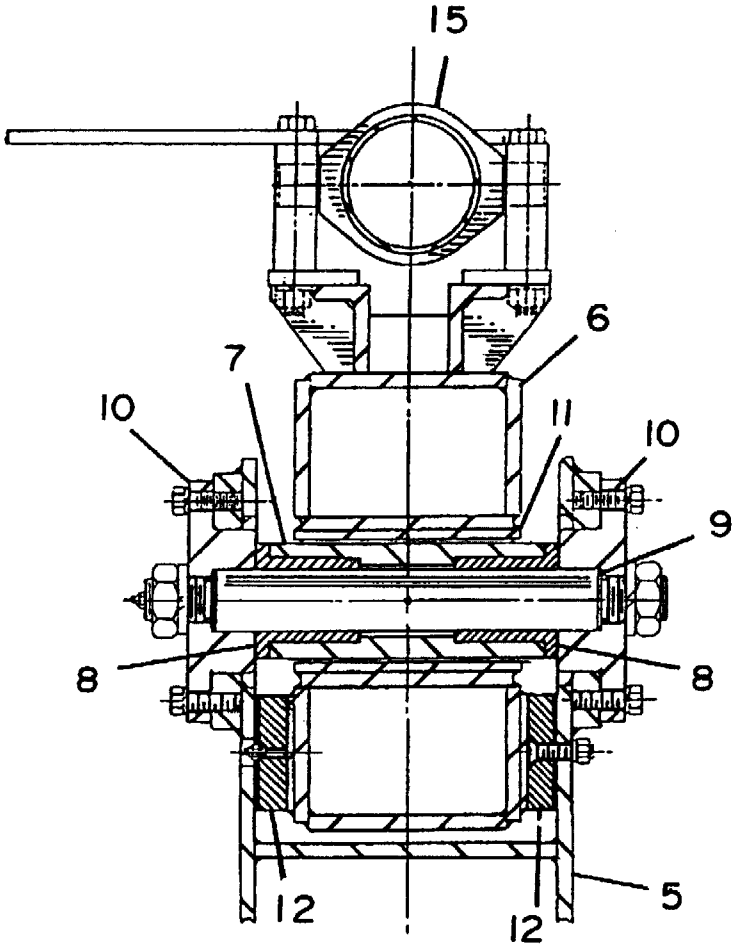
FIG. 4A is a cross-section of the telescoping hoist assembly of the present invention along line A—A of FIG. 3.

FIG. 4A is a cross section of the telescoping hoist assembly 1 of the present invention along line A—A of FIG. 3 and further illustrates the mast arm support 5, telescoping mast arm 6, sleeve bearings, mast arm roller shaft 9, roller shaft retainer 10, wear plates 11, mast arm guides 12, and hydraulic lift cylinder 15.

FIG. 4B is an end view of the telescoping hoist assembly 1 of the present invention along B—B of FIG. 3 and further illustrates the mast arm support 5, telescoping mast arm 6, mast arm hydraulic cylinder 13, hydraulic lift cylinder 15, and hose track 19.

Figure 5B:
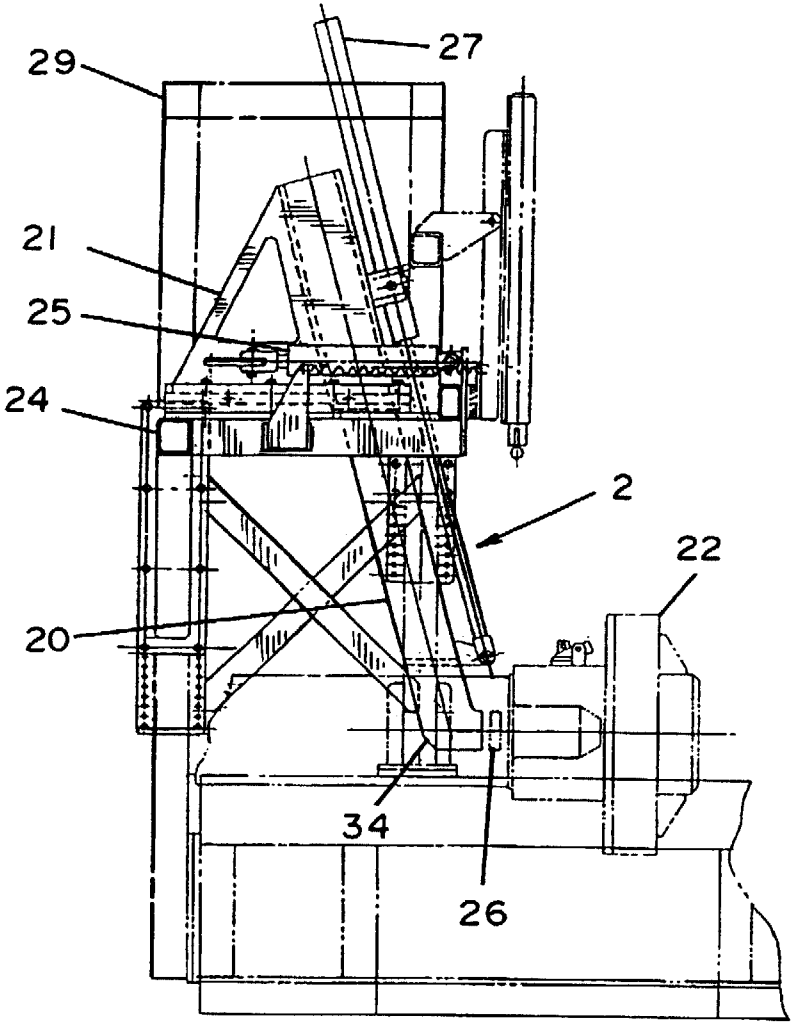
FIG. 5B shows a side elevation of the holding fork mechanism of the present invention with the fork ram shown in extended position and in relationship with the auger flight tab and drive chuck of an augering apparatus.
Figure 5A:
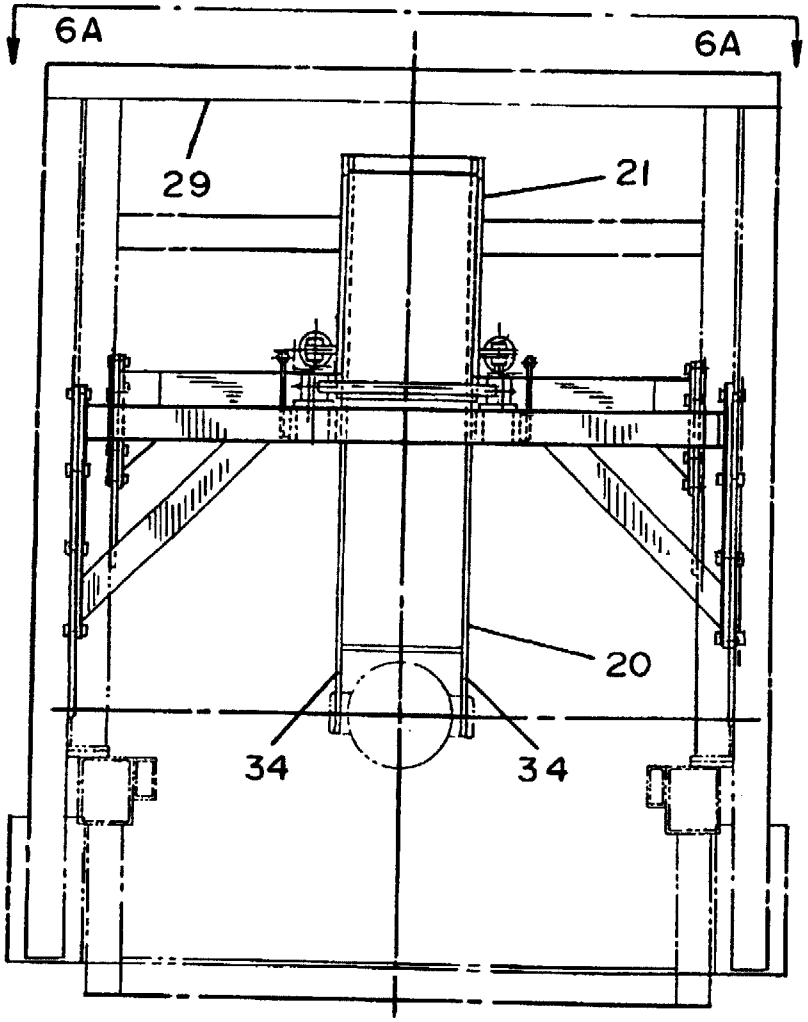
FIG. 5A shows a front elevation of the holding fork mechanism of the present invention with the fork ram shown in extended position.

FIG. 5A shows a front elevation of the holding fork mechanism 2 of the present invention with the fork ram 20 shown in extended position and further illustrates the fork mounting bracket 21, front high wall guard 29, and fork ram arms 34.

FIG. 5B shows a side elevation of the holding fork mechanism 2 of the present invention with the fork ram 20 shown in extended position and further illustrates fork mounting bracket 21, drive chuck 22, fork guide bracket support 24, fork slide hydraulic cylinder 25, auger flight tab 26, fork hydraulic cylinder 27, and front high wall guard 29.

Figure 6B:
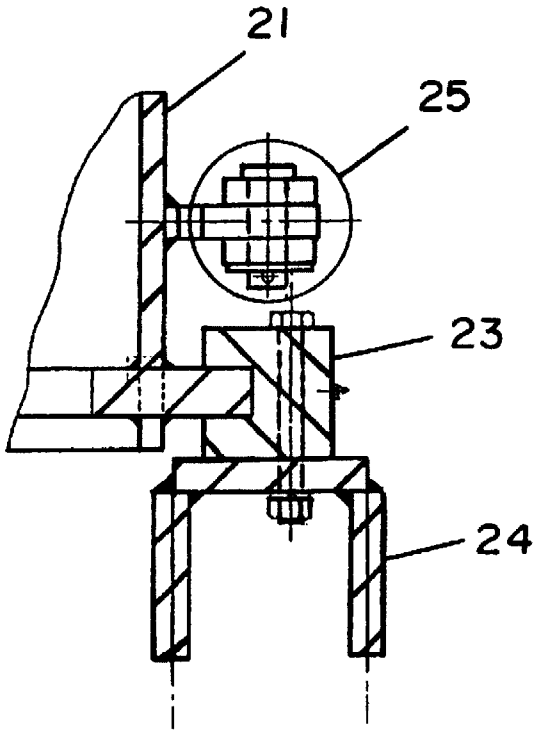
FIG. 6B is a section view of the holding fork mechanism of the present invention shown along line D—D of FIG. 6A showing the fork mounting bracket, fork lift guide bracket hydraulic cylinder, fork guide rail, and fork guide bracket support.
Figure 6A:
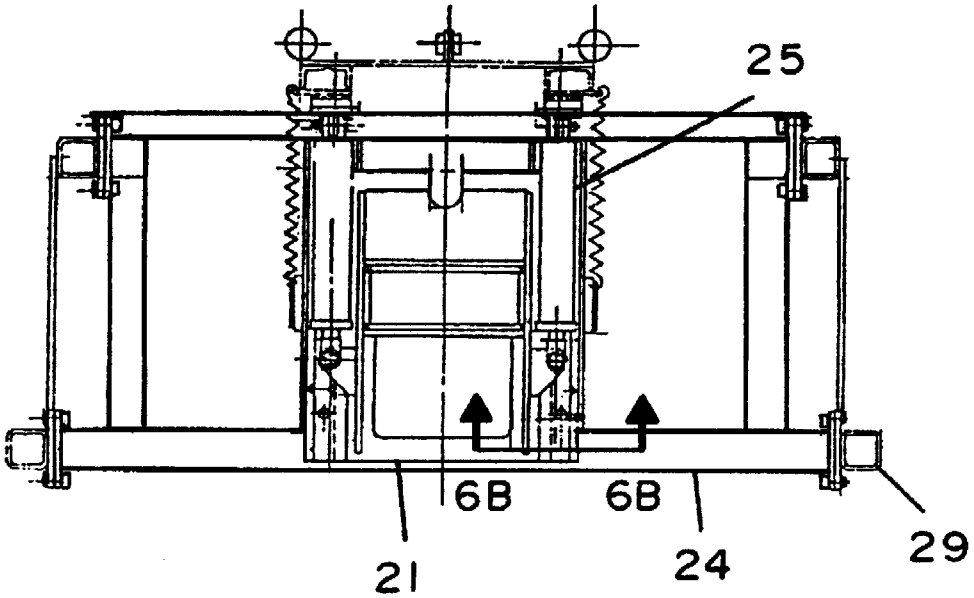
FIG. 6A is a plan view of the holding fork mechanism of the present invention along line C—C of FIG. 5A.

FIG. 6A is a plan view of the holding fork mechanism 2 of the present invention along line C—C of FIG. 5A and further illustrates the fork mounting bracket 21, fork guide bracket support 24, fork slide hydraulic cylinder 25, and the front high wall guard 29.

FIG. 6B is a section view of the holding fork mechanism 2 of the present invention shown along line D—D of FIG. 6A and further illustrates the fork mounting bracket 21, fork guide rail 23, fork guide bracket support 24, and fork slide hydraulic cylinder 25.

DESCRIPTION OF THE PREFERRED EMBODIMENT

Referring to FIGS. 1 through 6 the preferred embodiment of the present invention comprises a telescoping hoist assembly and holding fork mechanism to be used and adapted to an augering machine for the remote surface mining of coal although the present invention may be used in any augering apparatus. The present invention in preferred form comprises a telescoping hoist assembly with a maximum reach of twenty-one (21) feet and minimum reach of fourteen (14) feet with seven (7) foot of telescoping travel. This provides sufficient reach and flexibility to stack a sufficient number of auger flights for extended depth drilling and for the positioning of the hook of the telescoping hoist assembly directly over auger flights placed in a pile along side the machine which provides greater safety and provides variable drop positions for the auger flights since the proper drop position of the augers into the machine changes depending on the angle of the hole being augered by the machine. In preferred form the telescoping hoist assembly is of that configuration as illustrated in FIG. 3 and comprises a mast arm support, telescoping guide, and retaining rolls which are fixed to the mast arm support by way of bronze sleeve bearings, roller shafts and shaft retainers. The rollers support and guide the telescoping arm relative to vertical forces for lifting auger flights by way of hardened steel wear plates. Horizontal forces which occur when the hoist moves or swings are contained by way of brass wear shoes which are attached to the mast arm support and guide the telescoping arm of the mechanism as it is extended or retracted with the hydraulic telescoping cylinder. The telescoping arm in preferred form is designed with slots on the neutral axis which have little effect on the structural strength of the telescoping arm and allows the telescoping arm to be retained in the mast arm support with only two rollers. More conventional designs would require four (4) rollers comprising two (2) on top and two (2) on the bottom of the telescoping arm. A hydraulic lift cylinder is rigidly affixed to the top of the mast arm by way of trunion mounting with a lift cable sheave attached to the cylinder which slides along rails attached to the top of the mast arm. This provides for double reeving of the lift cable of the assembly giving total cable movement double the stroke of the lift cylinder and provides for the lift cylinder moving with the telescoping arm and allows the lift and telescopic functions to be completely independent functions, that is, telescoping does not effect or cause the cable to raise or lower during the telescoping function of the arm. The hoist assembly further provides for a hose track for the purposes of carrying and containing hydraulic hose that provide fluid to the hoist lift cylinder. Preferrably the lift cable is non-rotating wire rope.

The holding fork mechanism in preferred form as illustrated in FIGS. 5A and 5B, 6A and 6B, comprises a fork ram that is fabricated from high strength alloy steel and is mounted in and supported by a fork mounting bracket affixed to the high wall guard at the front of the augering machine. The fork ram cooperates with the fork mounting bracket and enables the fork ram to slide up and down by way of a hydraulic cylinder. In its retracted position it clears the auger flights and in its extended position it engages tabs that are welded to each auger flight. This engagement holds the auger flights from sliding typically down into the hole created by the augering function when trying to reconnect with the augering machines drive chuck. In addition, the fork mounting brackets in preferred form slide horizontally within guide rails affixed to guide brackets which are attached to the front high wall guard of the augering machine to position the fork ram horizontally to retrieve auger flights and allows the fork ram to provide resistance but also slide away from the high potential force of the propulsion unit of the augering machine in the event of misoperation by the operator. The fork ram is positioned by hydraulic cylinders which are connected to a hydraulic valve set at a predetermined pressure which is high enough to hold the auger flight string from sliding into the augered hole but low enough to allow the fork ram to slide away from the high force of the machine in the event that there is too much misalignment between the drive chuck of the machine and the auger flight. In the event that misalignment should occur, the fork mounting bracket can be returned to its original position by the hydraulic cylinders.

Although the invention has been described in preferred form with a certain degree of particularity, it is understood that the present disclosure of the preferred form has been made only by way of example and numerous changes in the details of construction and the combination arrangement of parts may be resorted to without departing from the spirit and scope of the invention as hereinafter claimed.

What is claimed is:

1. In an augering apparatus with a drive end and a cutting end comprising a frame, a carriage movable on the frame, a propulsion unit with drive chuck and means on said frame and carriage for rotating and advancing a cutting head driven by a string of auger flights and a front high wall guard disposed at the cutting end of the augering apparatus wherein the improvement is a telescoping hoist assembly disposed on the augering apparatus and adapted to move above and between a store of auger flights and said auger string for lifting said auger flights to add them to or to remove them from said auger string and comprises;

a mast socket rigidly fixed vertically to the frame of the augering apparatus and adapted to accept a mast pole within;

said mast pole which corresponds to and slidably engages within said mast socket and is adapted to rotate within said mast socket;

a telescoping mast arm support which is rigidly affixed atop the mast pole and is adapted to rotate about the mast socket;

a telescoping mast arm which is adapted to slide and telescope horizontally within the telescoping mast arm support and is disposed with a plurality of slots in the center of said telescoping mast arm, each slot adapted to accept telescoping mast arm rollers and to slidably move along the mast arm rollers;

a plurality of said telescoping mast arm rollers, each roller adapted to accept a roller shaft affixed to the telescoping mast arm support and rotate about said roller shaft and within the slots in the center of the telescoping mast arm;

a plurality of said roller shafts affixed to the telescoping mast arm support and adapted to cooperate with and pass through the mast arm rollers and the slots in the center of the telescoping mast arm;

a hydraulic telescoping cylinder affixed by means to the telescoping mast arm to move the telescoping mast arm horizontally in and out of the telescoping mast arm support;

a hydraulic lift cylinder rigidly affixed to the top of the telescoping mast arm at the mast pole end and adapted to connect with and move a lift cable sheave horizontally along a pair of parallel rails disposed between the hydraulic lift cylinder and a stationary lift cable sheave atop the telescoping mast arm;

a lift cable sheave affixed to the hydraulic lift cylinder and adapted to slide along a pair of parallel rails attached to the top of the telescoping mast arm;

said pair of parallel rails affixed to the top of the telescoping mast arm and adapted to accept the lift cable sheave and adapted to allow the lift cable sheave to slide horizontally along the top of the telescoping mast arm between the hydraulic lift cylinder an a stationary lift cable sheave;

said stationary lift cable sheave affixed to the other end of the telescoping mast arm and adapted to accept and cooperate with a lift cable and cooperate with the lift cable sheave;

said lift cable affixed at one end to the stationary lift cable sheave and passing through and cooperating with the lift cable sheave and said stationary lift cable sheave and affixed at the other end to an auger hoist hook;

said auger hoist hook disposed at one end of the lift cable;

a plurality of side guides affixed by means to the telescoping mast arm support and adapted to engage with and cooperate with the telescoping mast arm to stabilize movement of the mast arm horizontally;

activating means to activate the hydraulic telescoping cylinder and the hydraulic lift cylinders;

and a hose track to contain and cooperate with the activating means and the hydraulic telescoping cylinder and the hydraulic lift cylinder.

2. The telescoping hoist assembly of claim No. 1 wherein there are two telescoping mast arm rollers, two roller shafts, and there are two slots in the center of the telescoping mast arm.

3. The telescoping hoist assembly of claim No. 1 wherein the slots in the center of the telescoping mast arm are located on the center line of the arm.

4. In an augering apparatus with a drive end and a cutting end comprising a frame, a carriage movable on the frame, a propulsion unit with drive chuck and means on said frame and carriage for rotating and advancing a cutting head driven by a string of auger flights and a front high wall guard disposed at the cutting end of the augering apparatus wherein the improvement is a holding fork mechanism disposed at the cutting end of the augering apparatus and comprises:

a fork mounting bracket affixed to the front high wall guard of the augering apparatus adapted to be adjustable by fastening means vertically to correspond with the size of the auger flights and adapted to accept a fork ram to slide generally vertically within;

said fork ram corresponding to and adapted to slide vertically within the fork mounting bracket and formed at one end with arms to fit and cooperate with an auger tab;

a fork ram hydraulic cylinder affixed to the fork mounting bracket and fork ram and adapted to move the fork ram vertically within the fork mounting bracket;

two parallel guide bracket supports affixed to the front high wall guard of the augering apparatus and adapted to accept guide rails;

said guide rails affixed to each parallel guide bracket support and adapted to slidably accept the fork mounting bracket and to position the fork ram horizontally in the augering apparatus;

a guide bracket hydraulic cylinder affixed to the fork mounting bracket and high wall guard of the augering apparatus to move the fork mounting bracket horizontally;

activating means to activate the guide bracket hydraulic cylinder;

said arms formed at the lower end of the fork ram and adapted to correspond with and accept the auger tab affixed to the end of an auger flight;

said auger tab affixed to the end of an auger flight and adapted to correspond with and accept said arms.

5. The holding fork mechanism of claim No. 4 wherein the fork ram provides resistance to the slidability of the auger flight string but allows the auger flight string to slide away from the propulsion unit with drive chain augering of the apparatus in the event of misoperation by the operator.

* * * * *